US006838044B2

(12) United States Patent
Hörnschemeyer

(10) Patent No.: US 6,838,044 B2
(45) Date of Patent: Jan. 4, 2005

(54) COOLING PLATE AND METHOD FOR MANUFACTURING A COOLING PLATE

(75) Inventor: Wolfgang Hörnschemeyer, An der Alten Schmiede (DE)

(73) Assignee: KM Europa Metal AG (DE)

( * ) Notice: Subject to any disclaimer, the term of this patent is extended or adjusted under 35 U.S.C. 154(b) by 0 days.

(21) Appl. No.: 10/647,770

(22) Filed: Aug. 25, 2003

(65) Prior Publication Data

US 2004/0035510 A1 Feb. 26, 2004

Related U.S. Application Data

(62) Division of application No. 09/861,747, filed on May 21, 2001, now abandoned.

(30) Foreign Application Priority Data

May 19, 2000 (DE) ..... 100 24 587

(51) Int. Cl.[7] ..... B22D 11/00
(52) U.S. Cl. ..... 266/44; 266/193
(58) Field of Search ..... 266/193, 194, 266/44; 122/6 A, 6 B; 164/465

(56) References Cited

U.S. PATENT DOCUMENTS 5,678,806 A * 10/1997 Hille et al. ..... 266/193
6,470,958 B1 * 10/2002 Solvi et al. ..... 164/465

FOREIGN PATENT DOCUMENTS

DE 29 07 511 9/1980
DE 198 01 425 7/1999

* cited by examiner

*Primary Examiner*—Scott Kastler
(74) *Attorney, Agent, or Firm*—Kenyon & Kenyon

(57) ABSTRACT

The present invention relates to a cooling plate for use in the inner lining of metallurgical furnaces, especially smelting furnaces or shaft furnaces, and relates to a method for manufacturing a cooling plate. The cooling plate has a plate member, which is made of a copper material, and has integrated coolant channels. To manufacture the cooling plate, a raw ingot is provided, which is equipped with channels, and has a starting thickness that is greater than the final thickness of the plate member. The raw ingot is then deformed in a rolling step to reduce the starting thickness to the final thickness of the plate member and to deform the cross-sections of the channels. In this connection, the coolant channels obtain circularly oblong, final cross-sections.

2 Claims, 2 Drawing Sheets

COOLING PLATE AND METHOD FOR MANUFACTURING A COOLING PLATE

RELATED APPLICATION

This application is a divisional of U.S. patent application Ser. No. 09/861,747, filed May 21, 2001 now abandoned, which claims foreign benefits under 35 U.S.C. §119 of German Patent Application No. 100 24 587.0, filed May 19, 2000.

FIELD OF THE INVENTION

The present invention relates to a cooling plate and a method for manufacturing such a cooling plate for use in the inner lining of metallurgical furnaces, especially in smelting furnaces or shaft furnaces.

BACKGROUND OF THE INVENTION

For purposes of thermal insulation, metallurgical furnaces are provided with an interchangeable, metallic inner lining, on which insulating materials made of a fireproof material, such as fireproof clay, can be attached. The prevailing temperatures inside the furnace are so high, that the lining must be cooled. Cooling plates having integrated coolant channels are used in this connection. Such cooling plates are usually situated between the furnace shell and the furnace brick lining, and connected to the cooling system of the furnace. As a rule, the sides of the cooling plates facing the interior of the furnace are provided with fireproof material.

Cooling plates are known, in which the coolant channels are formed by cast-iron pipes. These cooling plates do not effectively dissipate heat. In part this is because of the low thermal conductivity of cast iron. Additionally, effective heat dissipation may be prevented by the resistance between the cooling pipes and the plate member caused by an oxide layer or an air gap.

Copper and copper alloys have a considerably better thermal conductivity than cast iron. In this context, DE 29 07 511 C2 describes a cooling plate for shaft furnaces, which is made of copper or a low-alloyed copper alloy, and is manufactured from a forged or rolled copper block. In this type of construction, coolant channels produced by mechanical deep-hole drilling are situated in the interior of the cooling plate. The coolant channels introduced into the cooling plate are sealed by soldering in or welding in screw caps. Inlet boreholes, which lead to the coolant channels, and are welded. or soldered to connecting pieces necessary for coolant supply or removal, are situated on the back of the cooling plate.

In addition, the related art of DE 198 01 425 A1 provides for the introduction of coolant channels into a cooling plate by mechanically removing material, and provides for covering the resulting channel pattern with a covering plate. To this end, the covering plate must be attached to the cooling plate, so as to form a seal. However, this procedure is particularly disadvantageous because of the necessary welding steps.

Coolant channels that are not round, e.g., channels that have oval or oblong cross-sections, have proven themselves reliable, because they provide a larger surface for transferring heat. Cast cooling plates, which are made of a copper material and have non-circular cooling channels, are known in this context. However, these have the disadvantage of the material being coarse-grained and non-uniform. This results in a poor thermal conductivity and the danger of early material fatigue. Furthermore, it is disadvantageous that structural defects of the material or damage to the material, such as microcracks on the cast cooling plate, are difficult to detect.

SUMMARY OF THE INVENTION

The object of the present invention is to provide a high-quality cooling plate having an increased cooling effect and a high efficiency, as well as to provide a method for cost-effectively manufacturing a cooling plate having coolant channels.

According to one embodiment of the invention, a cooling plate is provided for use in the inner lining of metallurgical furnaces, especially smelting or shaft furnaces. The cooling plate has a plate member that is made of a copper material having a fine-grained structure possessing an average particle size of less than 10 mm. The plate member has integrated coolant channels. The thickness of the plate member is reduced by machining the final cross sections of the coolant channels.

As for manufacture of the cooling plate, according to one embodiment of the invention, a method is provided including a number of steps. Initially, a raw ingot is provided that is made of a copper material. The ingot has a starting thickness that is greater than a final thickness of the plate member. The starting thickness of the raw ingot is reduced to the final thickness of the plate member, using at least one forming step. Coolant channels are produced in the raw ingot or the plate member prior to attaining the final thickness.

The present invention is described in detail below, using an exemplary embodiment represented in the drawings.

DESCRIPTION OF THE PREFERRED EMBODIMENT

Figure 1:
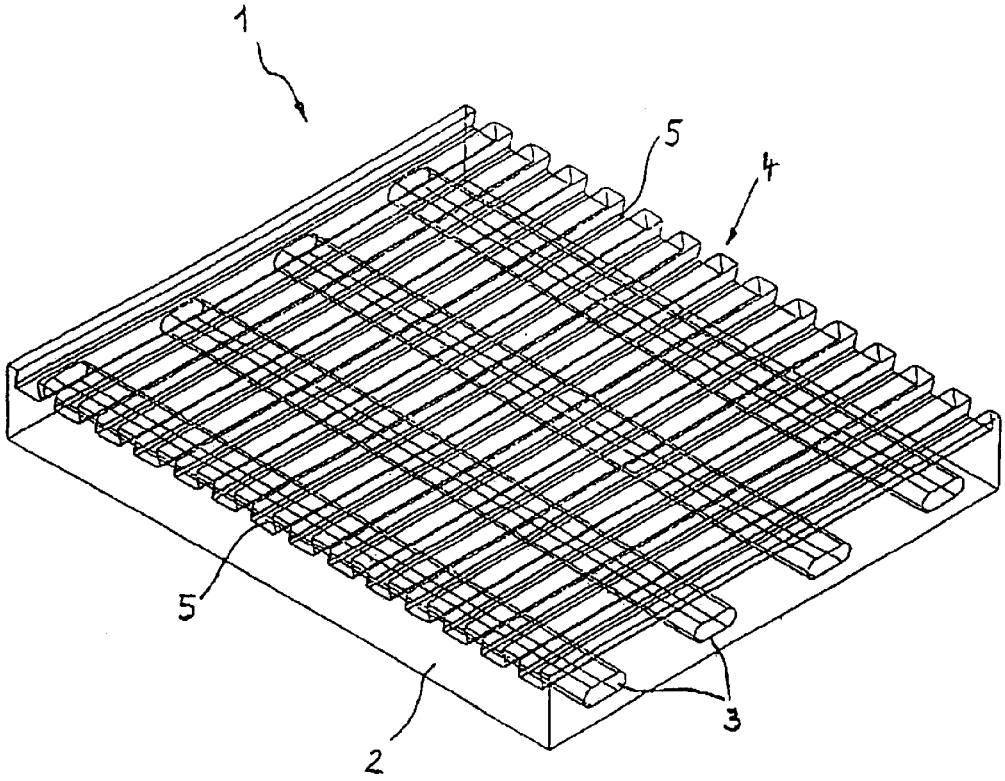
FIG. 1 is a perspective view of a cooling plate, according to one embodiment of the invention.

FIG. 1 shows a perspective view of a cooling plate 1 for use in the inner lining of metallurgical furnaces, especially smelting or shaft furnaces such as blast furnaces, reduction systems, or electric-arc furnaces.

Cooling plate 1 includes a plate member 2 made of copper or a copper alloy, into which oval (circularly oblong) coolant channels 3 are integrated. The copper material of plate member 2 has a fine-grained structure possessing an average particle size of less than 10 mm. A particle size less than 5 mm, preferably between 0.005 mm and 2 mm, is considered especially advantageous.

In one embodiment of the invention, a first side 4 of plate member 2 has grooves 5, which are subsequently introduced into plate member 2, in order to accommodate fireproof material.

Cooling plate 1 of the present invention distinguishes itself by improved cooling and a more uniform heating profile on the inner side of the furnace, i.e., on the surface facing the molten mass. The fine-grained structure improves the thermal conductivity considerably. A reduction in the wall thickness of cooling plate 1 is possible in combination with the final coolant-channel cross-sections, which are, in particular, circularly oblong. The cooling effect is considerably improved. In addition, material savings can be achieved.

Plate member 2 can be made of a kneaded copper material (or other forgeable alloy) having a fine-grained structure. However, rolled or cast material is also conceivable. Although it is theoretically possible to form the copper material hot, the present invention prefers a combined cold/hot forming, in particular a reduction in thickness, using rolling.

In accordance with a preferred embodiment of the invention, coolant channels 3 of plate member 2, whose thickness has been reduced, have an oval or circularly oblong, final cross-section. This helps to ensure that the heat-transfer surface is optimized for removing heat from the cooling plate.

Figure 2:
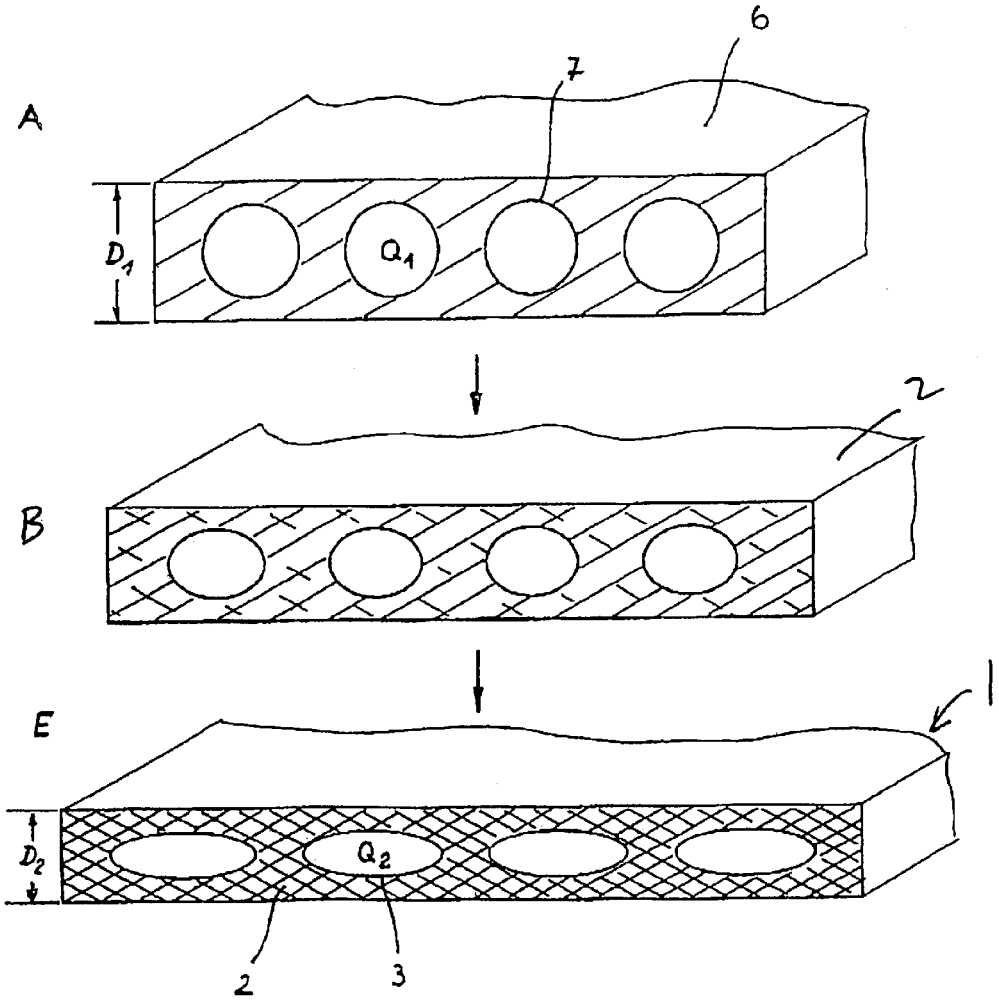
FIG. 2 is a schematic of the method sequence in the production of a cooling plate shown in FIG. 1, using three manufacturing steps.

The manufacture of plate member 2 is shown schematically in FIG. 2. The letter "A" indicates the initial state, and the letter "E" represents the final state. Accordingly, a raw ingot 6 of copper material is initially provided, which has a starting thickness greater $D_1$ than the final thickness $D_2$ of plate member 2. Raw ingot 6 can be made of a forgeable alloy, a cast material, or a rolled material. Channels 7 are mechanically drilled into raw ingot 6, using deep-hole drilling. One can see that channels 7 essentially have circular cross-sections in initial state A.

The thickness of raw ingot 6 is then reduced by at least one forming step as shown in the secondary state indicated by the letter "B", and indeed, to the final thickness $D_2$ of plate member 2. The reduction can be achieved by rolling, forging, extrusion, or pressing. It is also conceivable to combine these types of methods. Coolant channels $Q_1$. are introduced into raw ingot 6 or plate member 2 prior to attaining the final thickness $D_2$. Thus, coolant channels $Q_1$ can already be in raw ingot 6 to begin with, or they can be produced in the course of reducing the thickness. In this connection, it is conceivable to manufacture them in steps, while simultaneously changing their cross-sections.

It is understood that raw ingot 6 has a relatively coarse grain structure. In the rolling operation which has at least one stage, starting thickness $D_1$ of raw ingot 6 is reduced to final thickness $D_2$ of plate member 2. This rolling operation deforms cross-sections $Q_1$ of channels 7 into final cross-sections $Q_2$ which, as mentioned above, are preferably oval, and therefore, circularly oblong. During roll-forming, or a kneading step, plate member 2 obtains a fine-grained structure in the previously mentioned particle-size range.

In the end, plate member 2 whose thickness is reduced to final thickness $D_2$ can be examined for structural weak points or defects or possible damage, using ultrasonic material testing. Thus, weak points can be detected early, without causing breakdowns and disadvantageous operating stoppages in the plant.

In one embodiment of the invention, channels 7 having a circular cross-section are introduced into raw ingot 6 or plate member 2 prior to attaining the final thickness. Channels 7 can be produced using all known methods. If raw ingot 6 or plate member 2 is then deformed to the final thickness, the cross-sections of channels 7 are likewise deformed, and indeed, into the shape of an oval, and consequently, into the shape of an elongated circle. These cross-sections contribute to an improvement in the thermal conductivity.

In a particularly advantageous manufacturing step, the starting thickness of raw ingot 6 is initially reduced by cold rolling. In this manner, the copper material obtains a recrystallized, fine-grained structure, in which the typical, solidified structure of the cast copper of the ingot is substantially or completely eliminated. Channels, whose cross-sections are circular, are subsequently introduced into the raw ingot having a reduced thickness. The thickness of this raw ingot is then reduced to the final thickness in at least one working step, using hot rolling, the circular cross-sections of the channels being deformed into oval coolant-channel cross-sections that are advantageous from the standpoint of heat transfer.

Channels 7 in raw ingot 6 or plate member 2 can be drilled mechanically, using deep-hole drilling. However, it is also conceivable for the channels to be already cast in raw ingot 6.

The method allows the cost-effective manufacture of high-quality cooling plate 1, which has high efficiency improved cooling, along with a uniform heat profile of the surfaces acted upon by heat. In this manner, it is possible to reduce the wall thickness of a cooling plate 1 in comparison with conventional cooling plates having a coarse-grained structure. This results in material and cost savings.

Apart from the advantages of being efficient and inexpensive from a production standpoint, the method yields high-quality cooling plate 1 having plate member 2 that is distinguished by a structure possessing an average particle size of less than 10 mm. As mentioned above, the forming can achieve an even finer structure having particle sizes between 0.005 mm and 2 mm.

What is claimed is:

1. A method for manufacturing a cooling plate having a plate member, comprising the steps of:

initially providing a raw ingot made of a copper material, the raw ingot having a starting thickness greater than a final thickness of the plate member;

reducing the starting thickness of the raw ingot to the final thickness of the plate member, using at least one forming step; and producing coolant channels in one of the raw ingot and the plate member prior to attaining the final thickness wherein the step of reducing the starting thickness of a raw ingot is accomplished by cold rolling; the step of producing channels having circular cross-sections is subsequent to the rolling, the channels having a circular cross-section; and the step of reducing continues to reduce the ingot to the final thickness of the plate member, while the channels are deformed into coolant channels having oval cross-sections.

2. The method as recited in claim 1, wherein the channels having circular cross-sections are mechanically drilled into one of the raw ingot and the plate member, using a deep-hole drilling.

* * * * *